US006440092B1

(12) United States Patent
Leventhal et al.

(10) Patent No.: US 6,440,092 B1
(45) **Date of Patent: *Aug. 27, 2002**

(54) HARMONIC VIBRATION MASSAGE DEVICE

(75) Inventors: Robert D. Leventhal, Los Angeles; Paul B. Thomas, San Pedro, both of CA (US)

(73) Assignee: D2RM Corp., Gardena, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/467,562

(22) Filed: Dec. 20, 1999

(51) Int. Cl.[7] ..... A61H 1/00

(52) U.S. Cl. ..... 601/148; 601/46; 601/49; 601/84

(58) Field of Search ..... 601/46, 49, 55–60, 601/67–70, 134, 136, 148–150, 23, 27–32, 97, 98, 100, 101, 105; 606/201

(56) References Cited

U.S. PATENT DOCUMENTS 4,133,305 A * 1/1979 Steuer ..... 128/33
4,231,355 A * 11/1980 Hara ..... 128/24.2
4,570,616 A * 2/1986 Kunz et al. ..... 128/36
5,007,410 A * 4/1991 DeLaney ..... 128/33
5,020,517 A * 6/1991 Foster, Jr. et al. ..... 128/33
5,113,850 A * 5/1992 Larremore et al. ..... 128/32
5,181,504 A * 1/1993 Ono et al. ..... 128/36
5,462,515 A * 10/1995 Tseng ..... 601/57
5,716,331 A * 2/1998 Chang ..... 601/50
5,976,097 A * 11/1999 Jensen ..... 601/24
6,217,533 B1 * 4/2001 McCambridge ..... 601/56
6,234,987 B1 * 5/2001 Chen ..... 601/85

* cited by examiner

*Primary Examiner*—Justine R. Yu
(74) *Attorney, Agent, or Firm*—Thomas I. Rozsa; Tony D. Chen

(57) ABSTRACT

A harmonic vibration massage device for generating harmonic vibrations and including a transmitting plate and at least two vibration generators mounted underneath the transmitting plate. The transmitting plate has a plurality of protruding fingertips thereto. The at least two vibration generators generate two distinct vibrations at two distinct areas on the transmitting plate, where the two distinct vibrations are coupled together to produce harmonic vibrations such that the harmonic vibrations are transmitted to and through the transmitting plate which in turn is transmitted to and through the plurality of fingertips and the body part positioned on the massage device.

10 Claims, 7 Drawing Sheets

HARMONIC VIBRATION MASSAGE DEVICE

BACKGROUND OF THE INVENTION

1. Field of the Invention

The present invention generally relates to the field of massage devices. More particularly, the present invention relates to the field of massage devices having vibration generators or means for generating harmonic vibrations.

2. Description of the Prior Art

Specifically, massage devices are well known in the art. However, these prior art massage devices do not provide adequate massaging effect to a body part of a user to make them effective.

It is desirable to provide a harmonic vibration massage device with the capability of increasing or decreasing the amplitude of the harmonic vibrations generated by two or more vibration generators mounted to a transmitting plate. It is also desirable to provide a harmonic vibration massage device or the like that not only supports a weight of an individual who sits or rests on the harmonic vibration massage device but also provides in a much more efficient way a harmonic massaging effect on the body part of the individual positioned on the device.

SUMMARY OF THE INVENTION

The present invention is a harmonic vibration massage device for generating at least two wave forms at two distinct areas of a transmitting plate, where the wave forms are converging on each other to create a destructive harmony (lower amplitude), a constructive harmony (larger amplitude) or both (lower and larger amplitudes).

It has been discovered, according to the present invention, that by providing a harmonic vibration massage device with at least two or more vibration generators for generating two distinct vibrations at two distinct areas on a transmitting plate, the at least two vibration generators provide the two distinct vibrations which are coupled together to produce harmonic vibrations for providing a harmonic massage effect to a body part of a user.

It is an object of the present invention to provide a harmonic vibration massage device having at least two or more vibration generators or means, each for producing a different harmonic vibration at a different area of a transmitting plate.

It is also an object of the present invention to provide a harmonic vibration massage device having at least two or more vibration generators or means, wherein the wave forms generated by the vibration generators are in destructive harmony which has lower amplitudes.

It is an additional object of the present invention to provide a harmonic vibration massage device having at least two or more vibration generators or means, wherein the wave forms generated by the vibration generators are in constructive harmony which has larger amplitudes.

It is a further object of the present invention to provide a harmonic vibration massage device having at least two or more vibration generators or means, wherein the wave forms generated by the vibration generators are in destructive and constructive harmonies which include lower and larger amplitudes.

It is still a further object of the present invention to provide a harmonic vibration massage device having at least two or more vibration generators or means for generating harmonic vibrations at two distinct areas such that the harmonic vibrations are transmitted to and through transmitting means which in turn creates resonance vibrations to the massage device and the body part which is positioned on the massage device.

Described generally, the present invention is a harmonic vibration massage device having at least two or more vibration generators or means for generating harmonic vibrations to and through transmitting means which in turn creates resonance vibrations to the massage device and the body part positioned on the massage device. The transmitting means has a plurality of protruding fingertips or the like to improve the harmonic massaging effect on the body part of a user positioned against the protruding fingertips.

Described alternatively, the present invention is a harmonic vibration massage device having at least two or more vibration generators or means for generating harmonic vibrations to and through transmitting means which in turn creates resonance vibrations to the massage device and the body part positioned on the massage device. The transmitting means has an upper side with a plurality of protruding finger tips to improve the massaging effect on the body part of a user positioned against the protruding finger tips. The massage device is used in conjunction with a fluid filled bladder, where the fluid filled bladder is positioned underneath the massage device for creating increased pressure against the user.

Described further alternatively, the present invention is a harmonic vibration massage device having at least two or more vibration generators or means for generating harmonic vibrations to and through transmitting means which in turn creates resonance vibrations to the massage device and the body part positioned on the massage device. The massage device is used in conjunction with a fluid filled bladder with an irregular surface, where the fluid filled bladder is positioned on top of the transmitting means and the irregular surface conforms to the body part of a user.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
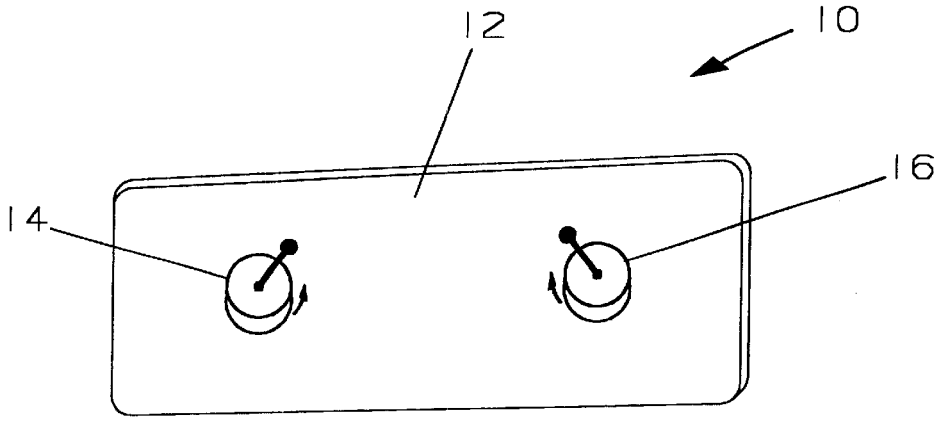
FIG. 1 is an illustrative diagram showing two vibration generators mounted at two separate locations on a transmitting plate upon a single plane.

Referring to FIG. 1, there is illustratively shown a preferred embodiment of the present invention harmonic vibration massage device 10 which includes a rectangular shaped transmitting plate 12 and at least two vibration generators 14 and 16 at two distinct areas of the transmitting plate 12.

Figure 2:
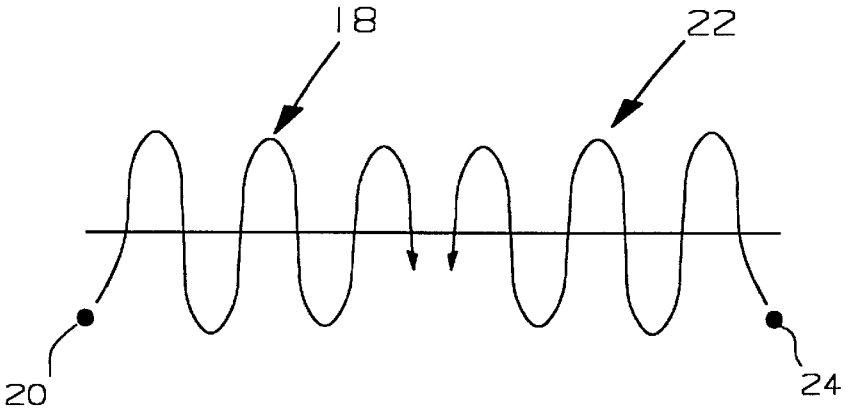
FIG. 2 is an illustrative diagram showing two wave forms generated at two distinct areas prior to convergence.

Referring to FIG. 2, there is illustratively shown a first wave form 18 generated by a first vibration generator 20 and a second wave form 22 generated by a second vibration generator 24 at two distinct areas prior to convergence.

Figure 3:
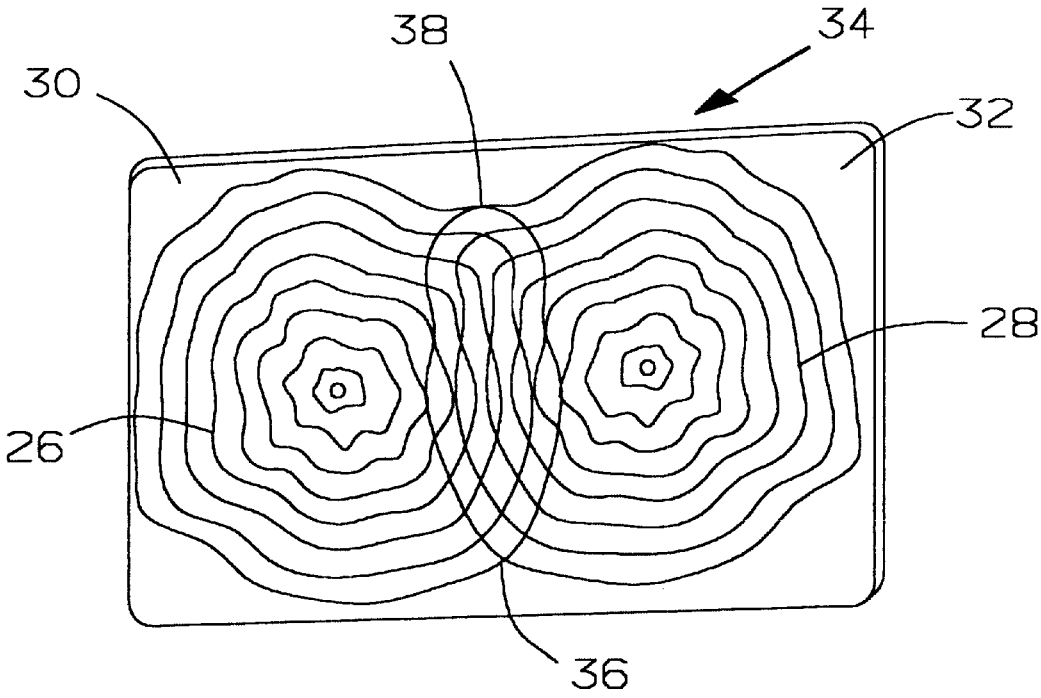
FIG. 3 is an illustrative diagram showing two wave forms generated at two distinct areas at an initial vibration convergence.

Referring to FIG. 3, there is illustratively shown two bending wave vibrations 26 and 28 over two distinct areas 30 and 32 on a transmitting plate 34 in its initial vibration convergence. According to the present invention, when there is a distribution of resonant modes of the first bending wave vibration 26 over one area 30 of the transmitting plate 34, and there is another distribution of resonant modes of the second bending wave vibration 28 over another area 32 of the transmitting plate 34, then there will be a distribution of resonant modes of a third bending wave vibration 36 in area 38 located between locations areas 30 and 32, where the third bending wave vibration 36 is produced by the resonance or interaction of the first and second bending wave vibrations 26 and 28.

Figure 4:
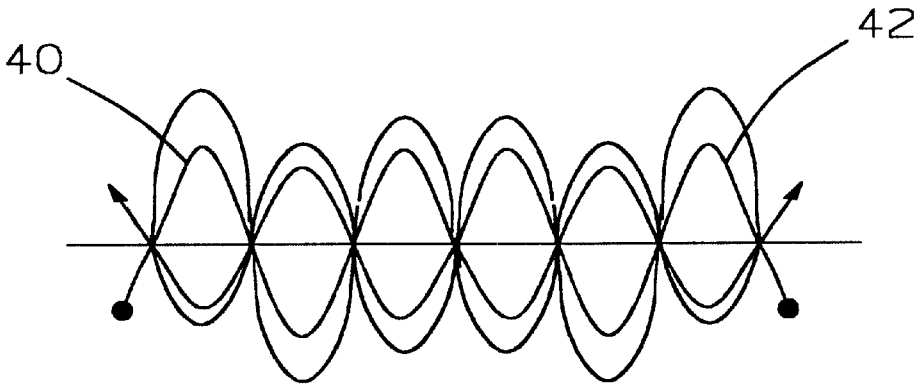
FIG. 4 is an illustrative diagram showing two wave forms in a destructive harmony, creating a lower amplitude of the harmony.

Referring to FIG. 4, there is illustratively shown two wave forms 40 and 42 in a destructive harmony, where the two wave forms create a lower amplitude of the harmony.

Figure 5:
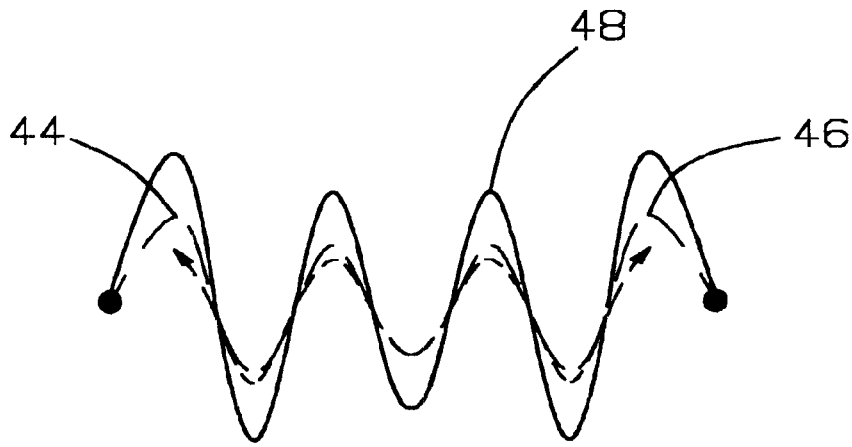
FIG. 5 is an illustrative diagram showing two wave forms in unison in a constructive harmony, creating a larger amplitude in the harmony.

Referring to FIG. 5, there is illustratively shown two wave forms 44 and 46 (shown as dashed lines) in a constructive harmony (unison), where the two wave forms create a larger amplitude of the harmony 48.

Figure 6:
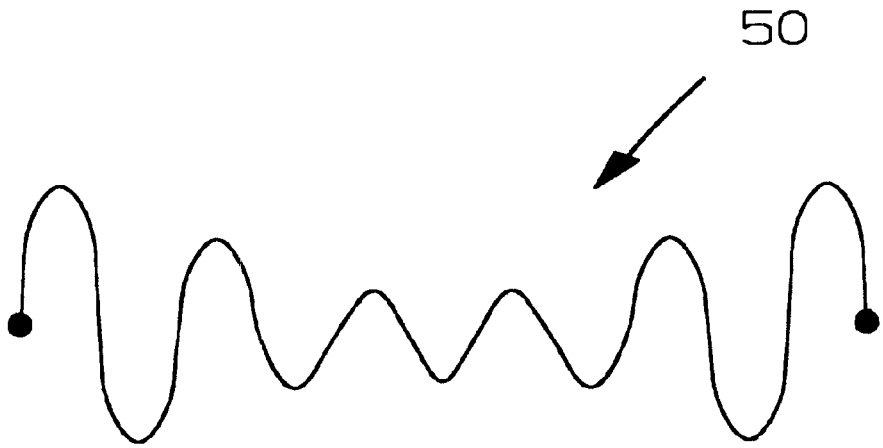
FIG. 6 is an illustrative diagram showing the harmonic of two wave forms, rising (constructive) and falling (destructive)

Referring to FIG. 6, there is illustratively shown the harmonic of two wave forms 50, wherein the wave forms are rising (constructive) and falling (destructive).

Figure 7:
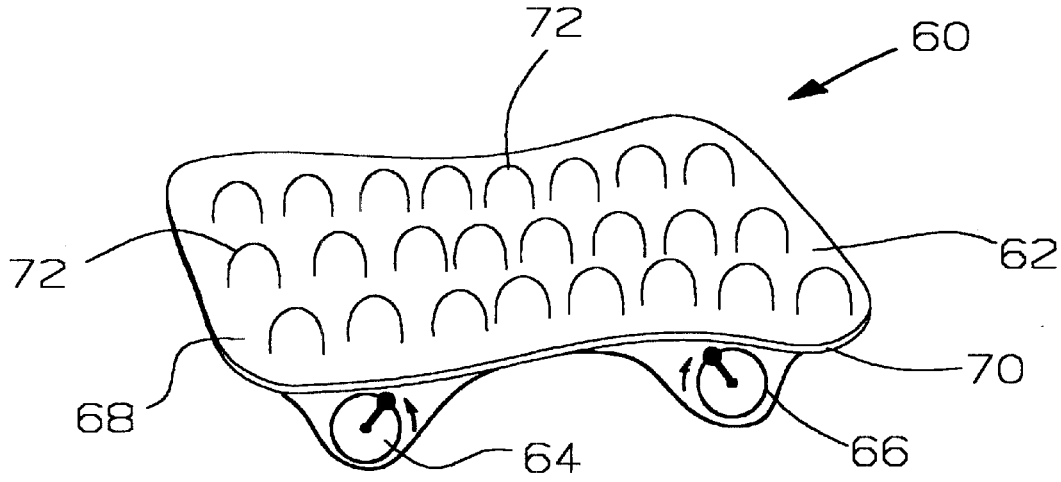
FIG. 7 is an illustrative diagram showing a preferred embodiment of the present invention harmonic vibration massage device.

Referring to FIG. 7, there is illustratively shown at 60 a preferred embodiment of the present invention harmonic vibration massage device which includes a rectangular shaped harmonic transmitting plate or panel 62 and at least two vibration generators 64 and 66. The vibration generators may include eccentric motors, solenoids, transducers, sonic transducers, vibratory means or any other suitable means known to one skilled in the art. The harmonic transmitting plate 62 has a top side 68, a bottom side 70 and a plurality of spaced apart protruding fingertips or the like 72 integrally formed with the top side 68. The two vibration generators 64 and 66 are mounted by conventional means on the bottom side 70 of the harmonic transmitting plate 62 at two distinct areas. The protruding fingertips 72 permit more intimate and penetrate contact with harmonic plate vibrations. The harmonic transmitting plate 62 is generally made out of rubber material, soft PVC, or semi-firm material which interacts with the vibration generators 64 and 66 to produce harmonic vibrations for providing a harmonic massaging effect.

Figure 8:
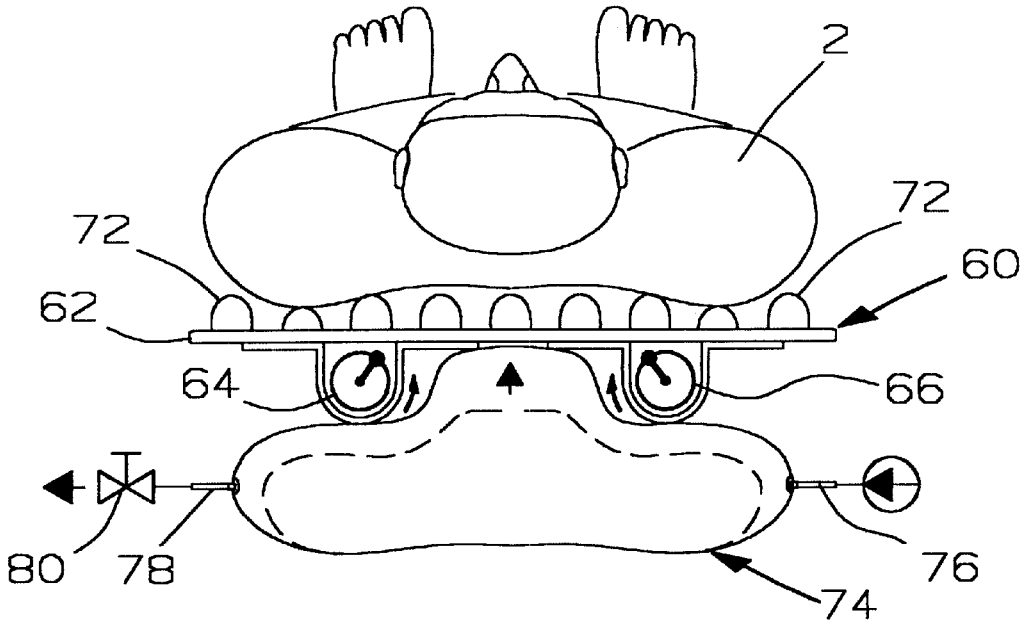
FIG. 8 is an illustrative diagram showing an alternative embodiment of the present invention harmonic vibration massage device used in conjunction with a fluid filled bladder for creating increased pressure against a user.

Referring to FIG. 8, there is shown the present invention harmonic vibration massage device 60 used in conjunction with a fluid filled bladder 74. The fluid filled bladder 74 is positioned underneath the transmitting plate 62 as shown. As the fluid filled bladder 74 is pressurized, it forces the massage device 60 upwardly against a body part of a user 2, thereby creating increased pressure against the body part of the user 2. The fluid filled bladder 74 provides both displacement with adjusting firmness against a user plus a damping media that accepts and adjusts harmonies.

The fluid filled bladder 74 has an inlet port 76 which is connected to air or fluid supply means (not shown) for pressurizing the bladder 74 and an outlet port 78 for depressurizing the bladder 74. The outlet port 78 may be connected to a valve 80 or control means for providing control over the outlet port 78.

Figure 9:
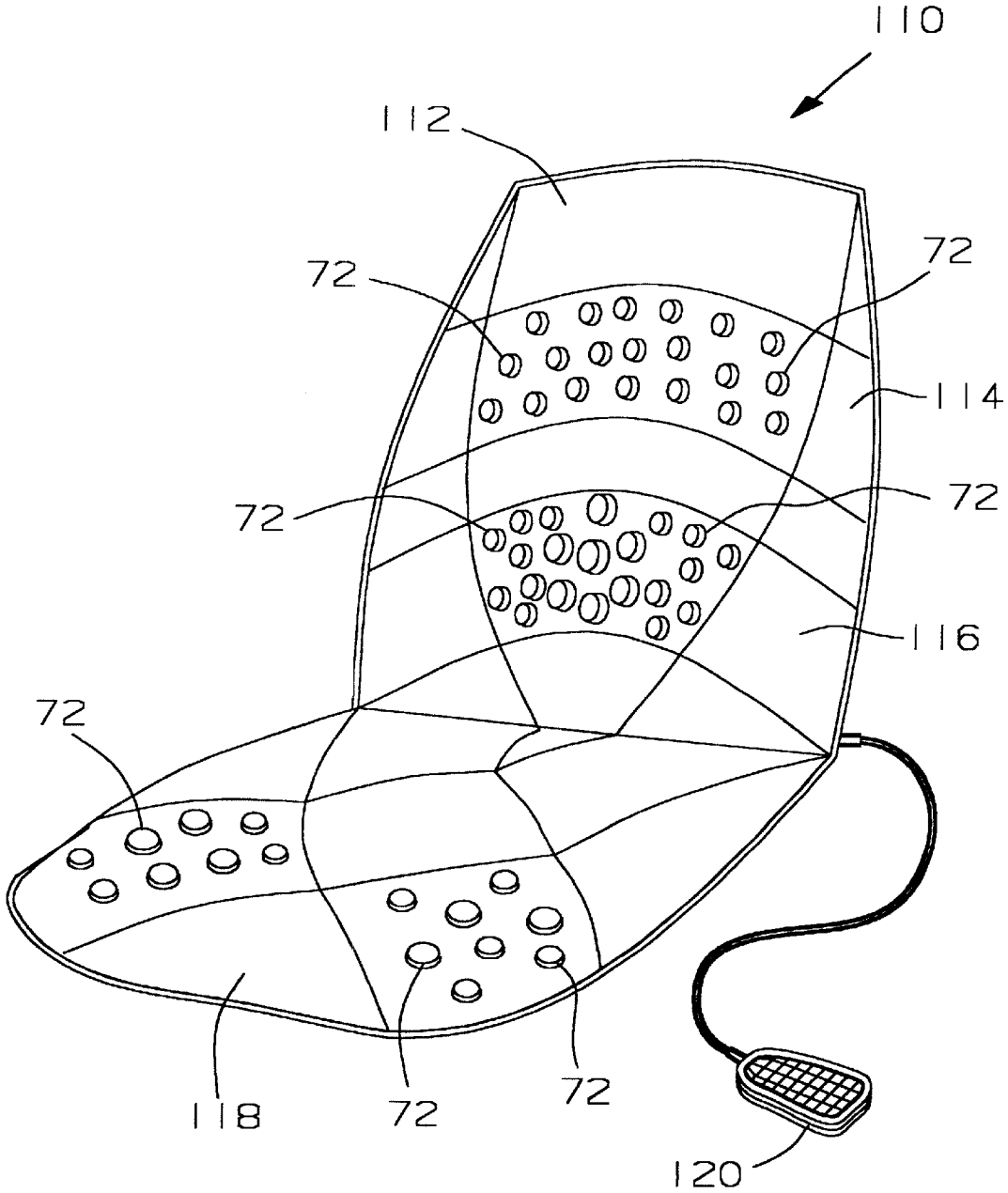
FIG. 9 is an illustrative diagram showing one arrangement of the present invention harmonic vibration massage device incorporated within a cushioning apparatus.
Figure 10:
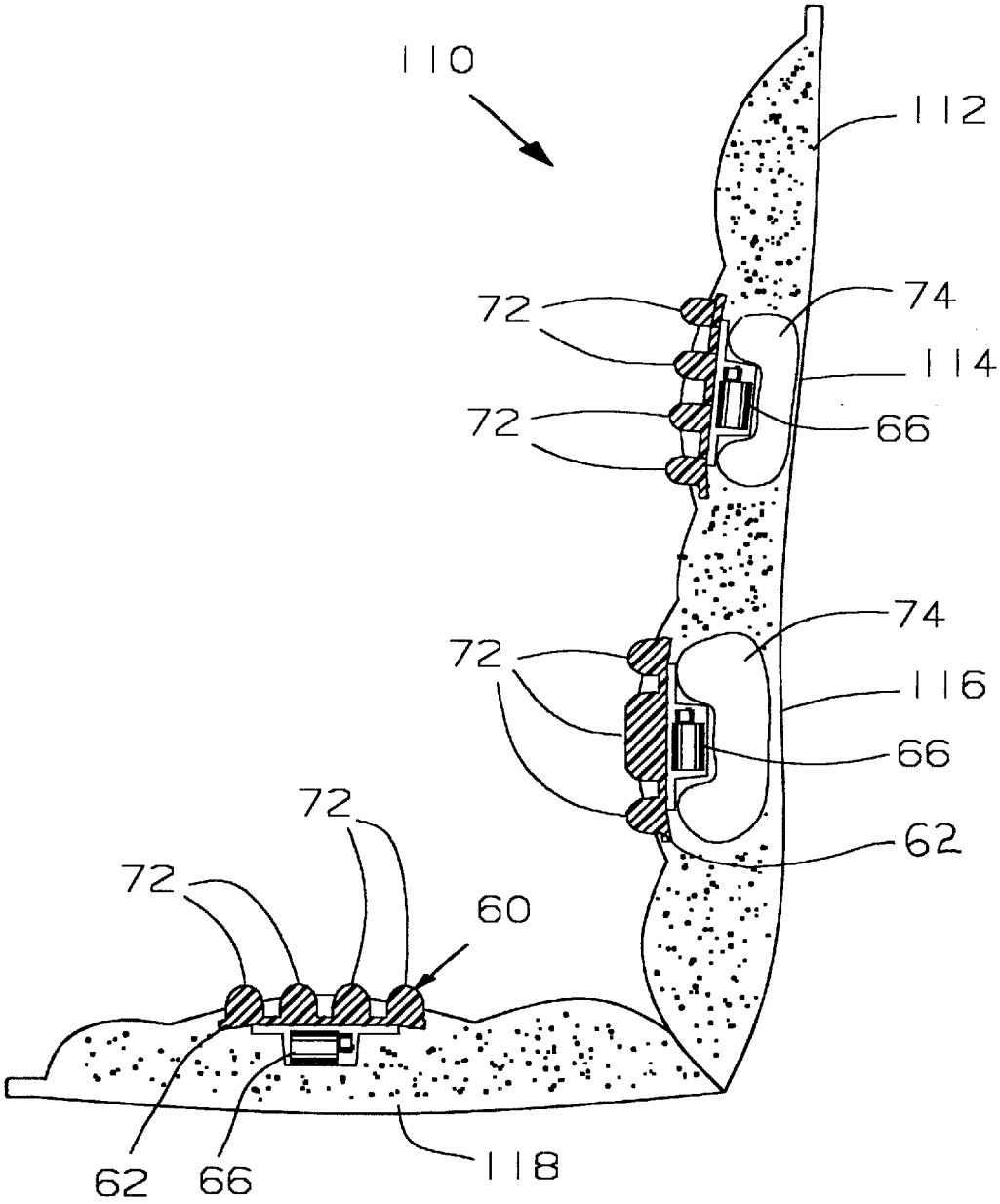
FIG. 10 is a cross-sectional view taken along line 10—10 of FIG. 9.

The above described embodiments of the present invention harmonic vibration massage device 60 can be implemented in many applications. Referring to FIGS. 9 and 10, there is shown one of the many applications of the present invention harmonic vibration massage device 60 incorporated into a cushioning apparatus 110. The cushioning apparatus 110 includes at least a head support section 112, a thoracic support section 114, a lumbar support section 116, and a buttock and thigh support section 118. Each support section may include the present invention harmonic vibration massage device 60 embedded thereto or therein. By way of example, only the thoracic support section 114, the lumbar support section 116 and the buttock and thigh support section 118 have the present invention harmonic vibration massage device 60 incorporated therein. The cushioning apparatus 110 further includes a control box 120 for controlling the harmonic massaging effect of the harmonic vibration massage devices 60 at different sections of the cushioning apparatus 110.

In the thoracic support section 114 of the cushioning apparatus 110, the present invention harmonic vibration massage device 60 is used in conjunction with the fluid filled bladder 74 as shown. In the lumbar support section 116 of the cushioning apparatus 110, the present invention harmonic vibration massage device 60 is used in conjunction with the fluid filled bladder 74 as shown. In the buttock and thigh support section 118, the present invention harmonic plate vibration massage device 60 is positioned thereto without the fluid filled bladder 74.

It will be appreciated that the cushioning apparatus 110 shown in FIG. 10 is not limited to the configuration shown. It is emphasized that while the configuration shown in FIG. 10 is preferred, it is also within the spirit and scope of the present invention to have any different configurations not shown. By way of example, all of the support sections of the cushioning apparatus may have the harmonic vibration massage device 60 embedded thereto with the fluid filled bladder 74. By way of example, all of the support sections of the cushioning apparatus may only have the harmonic vibration massage device embedded thereto.

The present invention harmonic vibration massage device 60 not only supports the weight of an individual who sits or rests on the device but provides a harmonic massaging effect on the body part of the individual positioned on the harmonic vibration massage device 60.

Figure 11:
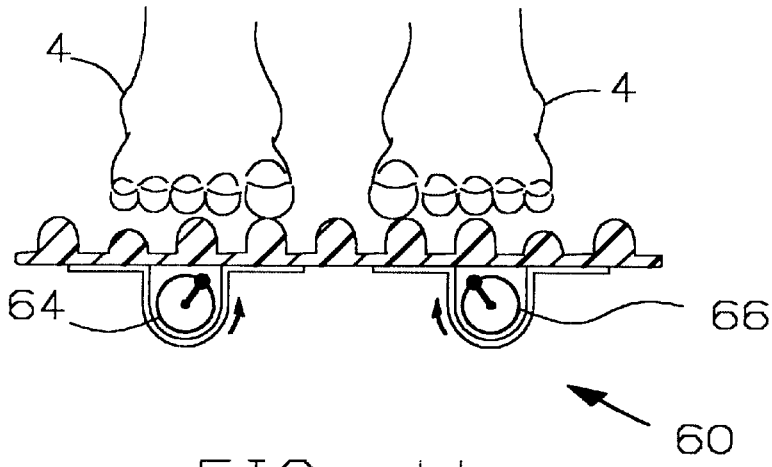
FIG. 11 is an illustrative diagram showing the present invention harmonic plate vibration massage device used on the user's feet.

Referring to FIG. 11, there is illustratively shown the present invention harmonic vibration massage device 60 which can be used on the user's feet for providing a harmonic massaging effect on the user's feet.

Figure 12:
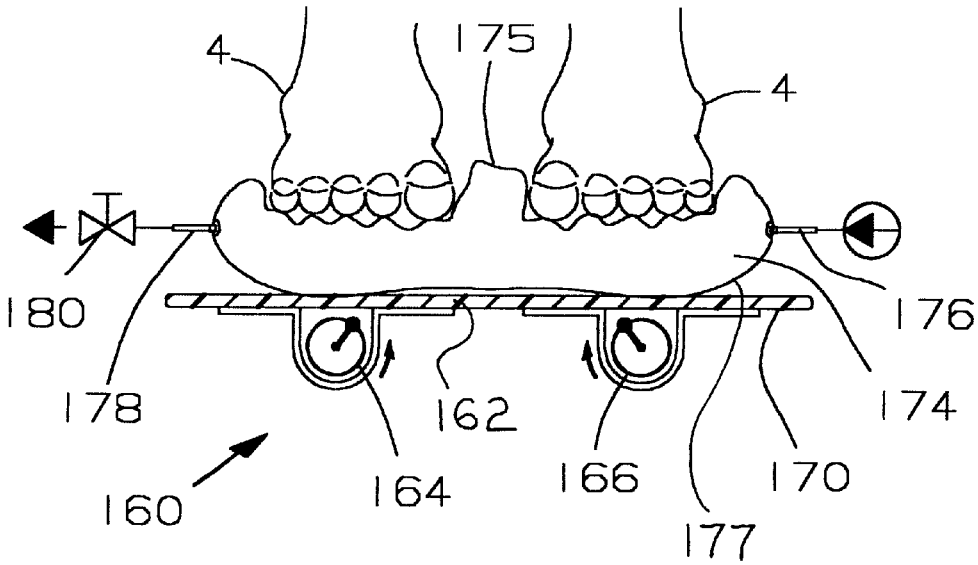
FIG. 12 is an illustrative diagram showing another embodiment of the present invention harmonic plate vibration massage device incorporated into a foot massage apparatus, where a fluid filled bladder has an irregular surface.

Referring FIG. 12, there is shown another embodiment of the present invention harmonic vibration massage device 160 incorporated with a foot massage device. The vibration massage device 160 is used in conjunction with a fluid filled bladder 174. The harmonic vibration massage device 60 includes a rectangular shaped transmitting plate or panel 162 and at least two vibration generators 164 and 166. The vibration generators may include eccentric motors, solenoids, transducers, sonic transducers, vibratory means or any other suitable means known to one skilled in the art. The harmonic plate 162 has a generally flat top side 168 and a bottom side 170. The two vibration generators 164 and 166 are mounted by conventional means on the bottom side 170 of the harmonic plate 162 at two distinct areas. The harmonic plate 162 is generally made out of rubber material, soft PVC, or semi-firm material which interacts with the vibration generators 164 and 166 to provide a harmonic massaging effect.

The fluid filled bladder 174 has an irregular upper surface 175 positioned against the user's feet 4 and a lower surface 177 positioned against the transmitting plate 162. As the fluid filled bladder 174 is pressurized, it provides a better conformity to the user's feet 4, thereby creating increased pressure against the user's feet 4. The fluid filled bladder 174 provides both displacement with adjusting firmness against a user plus a damping media that accepts and adjusts harmonies.

The fluid filled bladder 174 further has an inlet port 176 which is connected to air or fluid supply means (not shown) for pressurizing the bladder 174 and an outlet port 178 for depressurizing the bladder 174. The outlet port 178 may be connected to a valve 180 or control means for providing control over the outlet port 178.

Defined in detail, the present invention is a harmonic vibration massage device, comprising: (a) a transmitting plate having an upper side, a bottom side and a plurality of spaced apart protruding fingertips integrally formed with the upper side of the transmitting plate; (b) at least two vibration generators mounted on the bottom side of the transmitting plate and located at two distinct areas for generating two distinct vibrations at the two distinct areas, where the two distinct vibrations are coupled together to produce harmonic vibrations such that the harmonic vibrations are transmitted to and through the transmitting plate which in turn is transmitted to and through the plurality of protruding fingertips for providing a harmonic massage effect to a body part positioned on the harmonic vibration massage device; (c) a fluid filled bladder having an upper surface and a lower surface, the upper surface positioned against the bottom side of the transmitting plate and located between the at least two vibration generators; and (d) means for supplying fluid under pressure to expand the fluid filled bladder to a desired stiffness which in turn forces the plurality of protruding fingertips upwardly against the body part, thereby creating increased pressure against the body part positioned on the plurality of protruding fingertips of the transmitting plate.

Defined broadly, the present invention is a vibration massage device, comprising: (a) transmitting means having a plurality of protruding fingertips; (b) means for generating at least two distinct vibrations at least two distinct areas of the transmitting means, where the at least two distinct vibrations are coupled together to produce harmonic vibrations such that the harmonic vibrations are transmitted to and through the transmitting means for providing a harmonic massage effect to a body part positioned on the massage device; (c) a fluid filled bladder positioned against the transmitting means and located adjacent to the generating means; and (d) means for supplying fluid under pressure to expand the fluid filled bladder to a desired stiffness which in turn forces the plurality of protruding fingertips against the body part, thereby creating increased pressure against the body part positioned on the plurality of protruding fingertips of the transmitting means.

Defined alternatively in detail, the present invention is a harmonic vibration massage device, comprising: (a) a transmitting plate; (b) at least two vibration generators mounted on the transmitting plate and located at two distinct areas for generating two distinct vibrations at the two distinct areas, where the two distinct vibrations are coupled together to produce harmonic vibrations such that the harmonic vibrations are transmitted to and through the transmitting plate for providing a harmonic massage effect to a body part positioned against the harmonic vibration massage device; (c) a fluid filled bladder having an irregular upper surface for conforming to the body part and a lower surface positioned against the transmitting plate; and (d) means for supplying fluid under pressure to expand the fluid filled bladder to a desired stiffness to conform to the body part, thereby creating increased pressure against the body part.

Defined alternatively broadly, the present invention is a vibration massage device, comprising: (a) transmitting means; (b) means for generating at least two distinct vibrations at least two distinct areas of the transmitting means, where the at least two distinct vibrations are coupled together to produce harmonic vibrations such that the harmonic vibrations are transmitted to and through the transmitting means for providing a harmonic massage effect to a body part positioned on the massage device; (c) a fluid filled bladder having an irregular surface for conforming to the body part and positioned against the transmitting means; and (d) means for supplying fluid under pressure to expand the fluid filled bladder to a desired stiffness so that the irregular surface conforms to the body part, thereby creating increased pressure against the body part.

Further defined in detail, the present invention is a harmonic vibration massage device, comprising: (a) a transmitting plate having an upper side, a bottom side and a plurality of spaced apart protruding fingertips integrally formed with the upper side of the transmitting plate; and (b) at least two vibration generators mounted on the bottom side of the transmitting plate and located at two distinct areas for generating two distinct vibrations at the two distinct areas, where the two distinct vibrations are coupled together to produce harmonic vibrations such that the harmonic vibrations are transmitted to and through the transmitting plate which in turn is transmitted to and through the plurality of protruding fingertips for providing a harmonic massage effect to a body part positioned on the harmonic vibration massage device.

Further defined broadly, the present invention is a massage device, comprising: (a) transmitting means; and (b) means for generating at least two distinct vibrations at least two distinct areas of the transmitting means, where the at least two distinct vibrations are coupled together to produce harmonic vibrations such that the harmonic vibrations are transmitted to and through the transmitting means for providing a harmonic massage effect to a body part positioned on the massage device.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

The present invention has been described in considerable detail in order to comply with the patent laws by providing full public disclosure of at least one of its forms. However, such detailed description is not intended in any way to limit the broad features or principles of the present invention, or the scope of the patent to be granted. Therefore, the invention is to be limited only by the scope of the appended claims.

What is claimed is:

1. A harmonic vibration massage device, comprising:

a. a transmitting plate having an upper side, a bottom side and a plurality of spaced apart protruding fingertips integrally formed with the upper side of the transmitting plate;

b. at least two vibration generators mounted on said bottom side of said transmitting plate and located at two distinct areas for generating two distinct vibrations at the two distinct areas, where the two distinct vibrations are combined together to produce harmonic vibrations such that the harmonic vibrations are transmitted to and through said transmitting plate which in turn is transmitted to and through said plurality of protruding fingertips for providing a harmonic massage effect to a body part positioned on said harmonic vibration massage device;

c. a fluid filled bladder having an upper surface and a lower surface, the upper surface positioned against said bottom side of said transmitting plate and located between said at least two vibration generators; and d. means for supplying fluid under pressure to expand said fluid filled bladder to a desired stiffness which in turn forces said plurality of protruding fingertips upwardly against the body part, thereby creating increased pressure against the body part positioned on said plurality of protruding fingertips of said transmitting plate.

2. The harmonic vibration massage device in accordance with claim 1, wherein said harmonic vibration massage device is incorporated into a cushioning apparatus.

3. The harmonic vibration massage device in accordance with claim 1, wherein said harmonic vibration massage device is incorporated into a foot massage apparatus.

4. The harmonic vibration massage device in accordance with claim 1, wherein said transmitting plate is made out of rubber material.

5. A vibration massage device, comprising:

a. transmitting means having a plurality of protruding fingertips, the transmitting means including a plate;

b. means for generating at least two distinct vibrations for at least two distinct areas of said transmitting means, where the at least two distinct vibrations are combined together to produce harmonic vibrations such that the harmonic vibrations are transmitted to and through said transmitting means for providing a harmonic massage effect to a body part positioned on said massage device;

c. a fluid filled bladder positioned against said transmitting means and located adjacent to said generating means; and d. means for supplying fluid under pressure to expand said fluid filled bladder to a desired stiffness which in turn forces said plurality of protruding fingertips against the body part, thereby creating increased pressure against the body part positioned against said plurality of protruding fingertips of said transmitting means.

6. The vibration massage device in accordance with claim 5, wherein said plate is made out of rubber material.

7. The vibration massage device in accordance with claim 5, wherein said generating means include vibration generators.

8. The vibration massage device in accordance with claim 5, wherein said generating means include eccentric motors.

9. The vibration massage device in accordance with claim 5, wherein said vibration massage device is incorporated into a cushioning apparatus.

10. The vibration massage device in accordance with claim 5, wherein said vibration massage device is incorporated into a foot massage apparatus.

* * * * *